US007034681B2

(12) United States Patent
Yamamoto et al.

(10) Patent No.: US 7,034,681 B2
(45) Date of Patent: Apr. 25, 2006

(54) HOME SECURITY VIDEO SYSTEM USING INTERNET TECHNIQUE

(75) Inventors: Kenji Yamamoto, Sagamihara (JP); Koh Murata, Hino (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/989,772

(22) Filed: Nov. 20, 2001

(65) Prior Publication Data

US 2002/0118107 A1 Aug. 29, 2002

(30) Foreign Application Priority Data

Nov. 30, 2000 (JP) ..... 2000-365915

(51) Int. Cl.
*G08B 13/00* (2006.01)

(52) U.S. Cl. ..... 340/541; 340/531; 340/520; 348/153; 348/154; 379/44; 379/47

(58) Field of Classification Search ..... 340/531, 340/541, 500, 506, 501, 520; 348/143, 152, 348/153, 154, 155; 379/40, 44, 47
See application file for complete search history.

(56) References Cited

U.S. PATENT DOCUMENTS 3,686,434 A * 8/1972 Lemelson ..... 348/153
6,023,223 A * 2/2000 Baxter, Jr. ..... 340/531
6,060,994 A * 5/2000 Chen ..... 340/825.06
6,069,655 A * 5/2000 Seeley et al. ..... 348/154
6,097,429 A * 8/2000 Seeley et al. ..... 348/154
6,271,752 B1 * 8/2001 Vaios ..... 340/541
6,359,557 B1 * 3/2002 Bilder ..... 340/531

FOREIGN PATENT DOCUMENTS

| | | |
|---|---|---|
| FR | 2700046 | * 12/1992 |
| JP | 1-18899 | 1/1989 |
| JP | 2-54696 | 2/1990 |
| JP | 5-284247 | 10/1993 |
| JP | 06-089390 | 3/1994 |
| JP | 8-153292 | 6/1996 |
| JP | 10-173798 | 6/1998 |

(Continued)

OTHER PUBLICATIONS

Product Brochure titled "Orusuban eye," by TAKARA Co., Ltd., Oct. 2000. (not translated).

(Continued)

*Primary Examiner*—Jeffery Hofsass
*Assistant Examiner*—Daniel Previl

(57) ABSTRACT

A security system including several camera devices and a communication device in sites at which monitoring is required by a user. The several camera devices may constantly monitor the sites. The camera devices have motion detecting functions and provide unusual status reporting signals and necessary image information to the communications device when the movements of an intruder have been detected. The communication device communicates with and is connected to a server that serves as an information center via the internet line when unusual status signals have been received. The information from the camera devices is also sent to server. The server automatically notifies the user by a predetermined user-selected method. The notified user can access the server and confirm the information.

9 Claims, 3 Drawing Sheets

FOREIGN PATENT DOCUMENTS

| | | |
|---|---|---|
| JP | 10-304342 | 11/1998 |
| JP | 11-031282 | 2/1999 |
| JP | 11-066468 | 3/1999 |
| JP | 3060839 | 6/1999 |
| JP | 11-224383 | 8/1999 |
| JP | 11-283162 | 10/1999 |

OTHER PUBLICATIONS

Product Brochure titled "Motion Detector Module," by NIKON Corporation, Sep., 2000. (not translated).
Product Brochure titled "SECOM AX," by SECOM Co., Ltd. (not translated).

* cited by examiner

HOME SECURITY VIDEO SYSTEM USING INTERNET TECHNIQUE

CLAIM OF PRIORITY

This application claims priority under 35 USC §119 from Japanese Application No. 2000-365915, filed on Nov. 30, 2000.

BACKGROUND OF THE INVENTION

1. Field of the Invention

This invention relates to a security system, and, in particular, it relates to a security system which is a system for home security that is provided with communication functions of detecting illegal intruders from outside and reporting this information to those to whom it is necessary.

2. Description of the Related Art

Many conventional home security systems are systems for detecting whether or not there is an intruder by means of various sensors, which are installed in places for preventing crime. Most of such sensors utilize infrared radiation, and if something unusual happens, it is reported. For example, when an illegal intruder appears, the sensors detect it and send unusual signals to a centralized monitoring center using public telephone lines (including cell-phone systems) or dedicated lines. The monitoring person in the centralized monitoring center, who has confirmed something unusual has happened, send security guards to the place.

However, the greatest problem in this system is that we can not have sufficient confidence about an intruder solely from the sensor signals. If only sensors such as infrared sensors are used, error signals might be generated in many cases, and also in such a case, a reporting signal, which is the same type as when an intruder appears, is sent to the centralized monitoring center. The centralized monitoring center will take same measures as when there is an intruder. Therefore, these measures are in vain in such instances.

One of the monitoring methods for precisely confirm the presence of an intruder is to add image information, which is being tried. Such an example is described in Japanese Patent Application Publication No. 11-224,383 A, which was published in 1999. This system has a function of displaying the information from cameras, which are installed in places to be monitored, on the user terminal using a PHS system. This system also entails problems to be improved.

The first problem is that, although reporting information is transmitted promptly by means of this system, it also contains undesired or redundant information that are added to the requested information. As a result, excessive time is required for the user to have a confidence as to the presence of an intruder. For this reason, users who need information rapidly find above one is inconvenient and the communication costs for transmission of information is comparatively high. The second problem is that it was difficult to control multiple cameras, which are installed in sites to be monitored. According to the patent publication described above, just one monitoring camera is shown, which is installed in the site to be monitored. Conventionally, there was no system that could make reports where multiple monitoring cameras were used. The third problem relates to a function of saving image data. By means of the technology disclosed in the patent publication described above, the camera images are stored in memory as video images accompanied by a time delay. In this case, it is difficult to promptly pick up required video images and there are limits to memory capacity. Further, as described in above patent publication, installing an image recording device in the place to be monitored is not necessarily for preventing advantage.

Accordingly, in the light of the problems described above, the object of this invention is to provide a security system by which efficient transmission and practical use of accurate information can be realized in a relatively simple structure and with a low cost.

SUMMARY OF THE INVENTION

This invention provides a security system of detecting information about an intruder that has been obtained by a camera device fixed in a specified place to pass through a communication line for reporting to a user, characterized in that the system comprises several camera units that are installed in correspondence to said specified place to be monitored, a communication device that can be connected to said camera device and said_communication line to be connected to an internet line so that said communication device can communicate therewith, and a server means which can be connected to said communications device through said internet line; thereby each of said camera devices constantly monitors said specified place to find intruders, said devices communicate with said communication device to send reporting signals and image data to said communication device when a intruder is detected; establishes communication with said server means only when it has received said unusual status reporting signals, to collect said image data that have been received in specified units and to send them to said server means.

Preferably, said communication device is constructed such that units of said image data corresponding to said specified place are sent to said server means, and said image data are automatically deleted.

Preferably, the units of said image data in a specified place include several items of image data obtained from one of said multiple-camera devices at different times.

Preferably, the interconnections between said camera devices and said communication device are formed by a power source line or by wireless means.

Preferably, said server means provides image information based on said image data to a specified web site.

Preferably, said server unit reports to a terminal that has been registered in advance when said image data have been received.

Preferably, said reporting is performed using the internet line means.

Preferably, said camera devices can also detect voice information, combine voice data based on said voice information with said image data and transmit combined data.

Preferably, said server means includes a web server means and a data base server means.

Namely, according to the security system of this invention, several camera devices and communication devices are installed in sites at which monitoring is necessary for the user. When the security mode is turned on, the several camera devices operate so that specified positions of the site are monitored. Each camera device itself has a function of motion detection. The unusual status reporting signals and the necessary imaging information are provided to the communication means only when the camera device detects the motion of an intruder. Because the images taken by the camera devices are the major criteria for judgment, the number of error reports can be decreased. The communication means is connected to the server that acts as an information center using the internet line only when an unusual status reporting signal has been received from a camera device and the information from the camera device is also provided to the server means at this time. The image is transmitted at the same time as the abnormality information or after transmission has been completed. At this time, the server means can automatically inform the user or another person by a method that can be selected by the user in advance. The user who has been informed, can access to the server means and check the detailed information regarding the unusual status from at least one image. As a result, the system can be constructed comparatively simply and inexpensively and is also easy for the user to use.

A user who has been notified can access the communication means through the web server and can confirm image information and other information from each camera. At this time, the system is constructed so that the user can control each camera device remotely from the user terminal. At this time, the server means can select a suitable internet service provider so that the fees required for public telephone lines among the communication lines necessary for the purpose of control can be kept at a minimum.

It is possible that notification to other persons is not automatic and can be set up so that such notification is first executed as a result of access from the user. In this case, the server means can select a suitable connection point from information that has been given in advance, or information that has been received at the time of receipt of the unusual status reporting signal, or information that has been given by the user when there was an access from the user, and so on. At the time this communication is established, as described in the previous section, a suitable internet service provider can be selected.

BRIEF DESCRIPTION OF THE DRAWINGS

The above set forth and other features of the invention will become apparent from the Detailed Description of the Invention in conjunction with the attached Drawings, wherein.

DETAILED DESCRIPTION OF THE INVENTION

We shall now present a detailed description of the structure of the security system that is a desirable mode of execution of this invention by reference to the appended figures.

| | |
|---|---|
| 10 | server means |
| 11 | web server |
| 12 | data base server |
| 20 | communications device |
| 21, 22, 23 | camera devices |
| 100 | security system |

Figure 1:
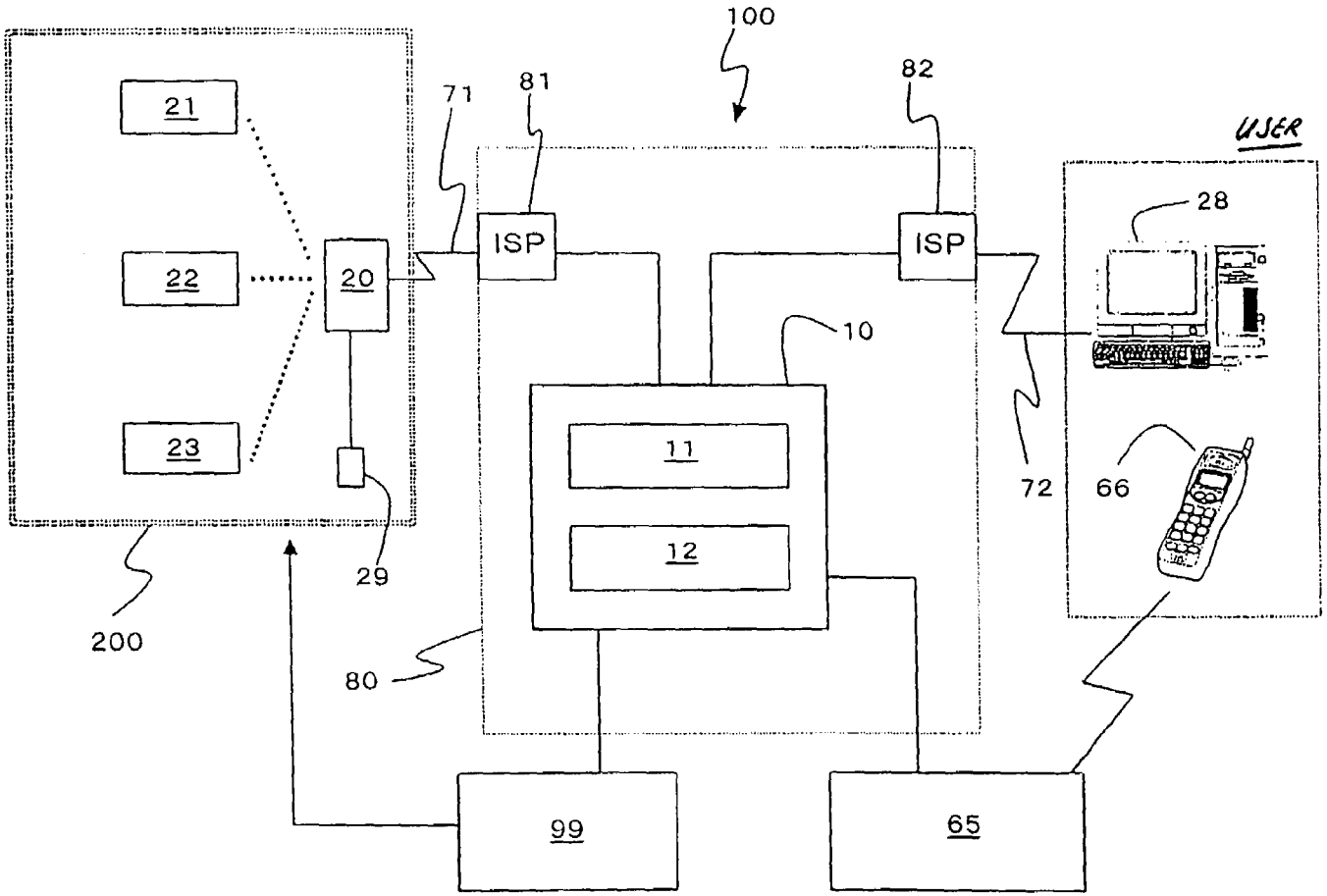
FIG. 1 shows a schematic diagram of a security system that is a desirable mode of execution of this invention.

FIG. 1 is a schematic diagram of the security system 100 that is a desirable embodiment this invention. It can be understood that this security system 100, which makes use of the internet line 80, is constructed with server means 10 as its center. Server means 10 contains the web server 11 and the database server 12. On the other hand, several camera devices 21, 22 and 23 and at least one communications device 20 are installed in the place 200 that is to be monitored in the buildings for each family. When security system 100 is used for home security, camera devices 21, 22 and 23 are installed in the necessary sites inside and outside the house. Although there are three camera devices in the figure, there is no limitation on the number of devices, and the number can be increased or decreased, as required. As shown in FIG. 1, the sensor 29 is also installed. In the specification no particularly detailed description about the sensor 29, but the sensor 29 can send some information to server means 10, (the database server 12) and is also used for judging the situation.

As described, camera devices 21, 22 and 23 can communicate with communications device 20. The communication between camera devices 21, 22 and 23 and communications device 20 can be lines that are installed in ordinary houses such as power source lines and wireless communication means such as Bluetooth™. On the other hand, communications device 20 can be connected to web server 11 of server means 10 through public telephone line 71 by dial-up connections, and the internet service provider 81. Further, server means 10 can be connected to user terminal 28, which can form a mirror image architecture, through internet line 80, the internet service provider 82 and the public telephone line 72. Establishment of communication and its action will be described subsequently.

Figure 2:
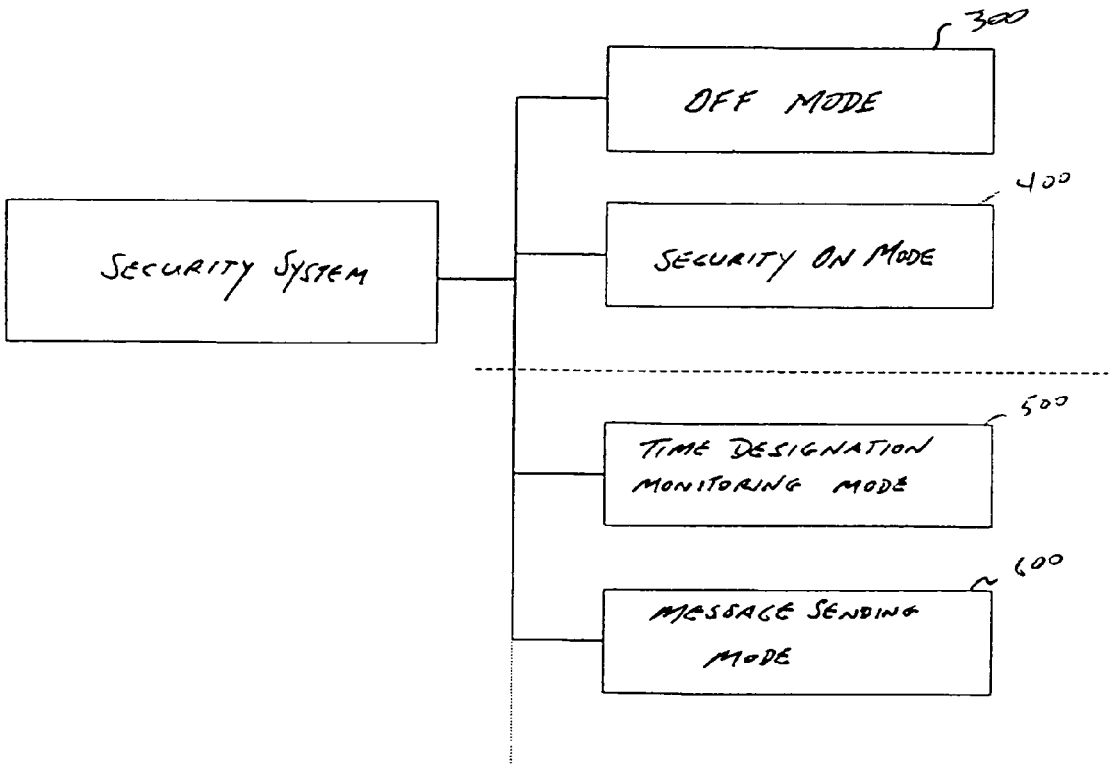
FIG. 2 shows a figure that illustrates the four types of operating modes in the security system of this invention as shown in FIG. 1.

FIG. 2 shows the four types of setting modes of the system. Switching of these setting modes can be performed by communications device 20. "Off mode" signifies a state in which a person or owner exists in [is at] the site, and there is no need of monitoring and camera devices 21, 22 and 23 are not being performed. "Security on mode" is the mode that is set when the owner is not present and monitoring by camera devices 21, 22 and 23 is requested. For example, when the owner is going out and this mode has been selected, operation of this mode begins and monitoring by camera devices 21, 22 and 23 can start after preselected time for the controller to go out. The other two modes, the "time designation mode" and the "message sending mode" are not always necessary and they are for providing supplemental actions. This will be discussed subsequently. Prior to that, we shall present a detailed description of the action of the "security on mode." Other modes also can be set in security system 100.

Figure 3:
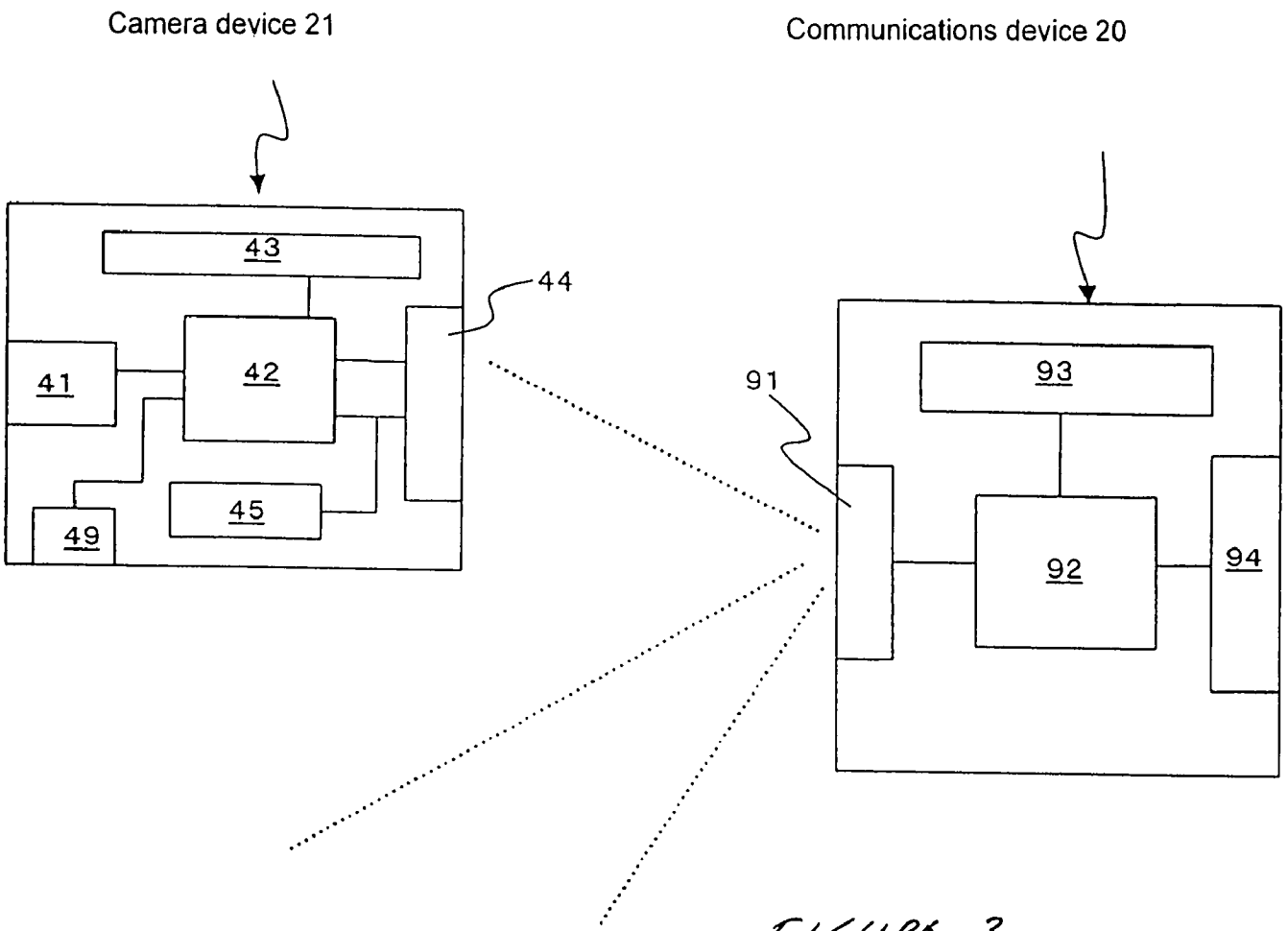
FIG. 3 shows a schematic diagram that shows the detailed structure of the camera device and the communications device in the security system shown in FIG. 1.

FIG. 3 shows the detailed structure of camera devices 21, 22 and 23 and of communications device 20 that are installed at the site 200 to be monitored. Because camera devices 21, 22 and 23 have the same structure, we shall describe only camera device 21 as a representative example. Camera device 21 has the camera image-receiving component 41, the data-processing component 42, the memory component 43, the transmitting-receiving component 44 and the control component 45. The communications device 20 has the first transmitting-receiving component 91, data processing component 92, the memory component 93 and the second transmitting-receiving component 94. Camera devices 21, 22 and 23 also have the voice detection unit 49, which includes a microphone so that voice information can be incorporated in addition to image information and it can be combined with image data to serve as monitoring data. Consequently, although we shall describe only image data for convenience in the subsequent explanation, the term image data can also include voice data.

When the system is set to the "security on mode," cameras 21, 22 and 23 receive the signal of operation starting from communications device 20. At this time, camera devices 21, 22 and 23 either operate independently from the communication device 20 with the communication being off state or have communication of preparation signal exchange with communication device 20 under decreased power consumption.

We shall describe this operation of camera device 21 as a representative example. The camera image-receiving component 41 inside camera device 21 sends the received image to data-processing component 42 as image data. Data-processing unit 42 has a function of motion detection for detecting objects performing specified movements. Specifically, when an image of a moving intruder is imaged in camera image-receiving component 41, the presence of the intruder can be detected from the information relating to movement in the image data in data-processing component 42 which has received the corresponding image data.

When the presence of an intruder has been detected by data-processing component 42, camera device 21 for the first time establishes a communication connection with communications device 20 and an unusual status reporting signal is sent from transmitting-receiving component 44 to first transmitting-receiving component 91 of communications device 20. The image data before and after detecting the presence of the intruder, as required, are stored in memory component 43 as a still image. All or some of these data are sent to communications device 20 with the unusual status reporting signal or after the signal has been transmitted.

In first transmitting-receiving component 91, communications device 20, which has received an unusual status reporting signal from at least one of camera devices 21, 22 and 23, operates so as to establish a connection to the internet service provider (ISP) 81 that is to be connected to server means 10 by the second transmitting-receiving component 94. In addition, adjustment of the image data that have been received is performed in data-processing component 92. The image data are adjusted as time-passage still images by each of camera devices 21, 22 and 23 which have received unusual status reporting signals. When the communication connection has been established, communications device 20 sends the unusual status reporting signal and the adjusted image data to server means 10. The unusual status reporting signal and the image data can be combined or they can be sent separately. In both cases, they are transmitted as data forms which include information of relation with camera devices 21, 22 and 23. The image data that have been sent to server means 10 are stored in database server 12. The image data that have been stored temporarily in camera devices 21, 22 and 23 and communications device 20 can be deleted after they have been transmitted appropriately to the next-stage device.

When an unusual status reporting signal is sent to server means 10 and if the user wishes, automatic notification is performed for the purpose of reporting the fact that there was an unusual status reporting status signal from server means 10. The means of notification can be an electronic mail using internet line 80 to deliver mail to user terminal 28, portable telephone through the telephone company 65 or a telephone 66 in a fixed position. (See FIG. 1.) The user can promptly know some trouble when he is not present. The notification address in this case is not limited to one place and may be several places.

The image data that have been sent to database server 12 can be seen from the outside by receiving validation when the user access the specific web site. Namely, the user who was informed of the unusual status can know the cause of the report by going onto internet line 80 and accessing web server 11. At the web site, images before and after the abnormality, for example, images of a moving intruder, can be checked so that the user can promptly confirm the presence of an intruder.

Although not shown in the figure, in such a case, a suitable contact address is prepared on the web site for supporting a prompt response by the user. For example, when the user has confirmed the presence of an intruder, it is possible to connect promptly to a security-guard company or the police 99 through the agency of the web site (i.e., web server 11) so that the intruder can be captured. At this time, by means of the web site (not shown) the user can make a notification by him to some persons by registering a connection address in advance on the web site, which are not the security-guard company or police 99.

A further characteristic of security system 100 according to the embodiment of the present invention is that the user can control communications device 20 and camera devices 21, 22 and 23 from user terminal 28. By means of the "security on mode", a request can be made for confirmation of the state from the user side not only when a report has been made but also when a natural disaster such as an earthquake or flooding has occurred. In this embodiment it is realized using internet line 80 in which server means 10 is interposed.

The user, when necessary, enters the internet line 80 from his own user terminal 28 through the internet service provider 82 and accesses the web site, which is not shown in the figure, but provided by server means 10. On the web site, a menu is prepared for controlling the registered communications device 20 and camera devices 21, 22 and 23 that can communicate with the communication device 20 after user validation. The user selects an appropriate menu, and, by performing a suitable operation, for example, by remotely controlling the control component 45, can make changes in the monitoring angle range and set mode of camera devices 21, 22 and 23.

Further, the user can access the web site and command the acquisition of existing images from camera devices 21, 22 and 23. In this case, server means 10 establishes communication with communications device 20 on the basis of information that has been provided in advance through the agency of a suitable internet service provider 81 and commands acquisition of images to communications device 20. Communications device 20 forcibly commands camera devices 21, 22 and 23 to transmit the existing image data that have been received. Following that, when camera devices 21, 22 and 23 find an abnormality due to an intruder, the image data are stored in data server means 12 of server means 10 as a result of flow of the same data. In this case, server means 10 notifies user terminal 28 that image acquisition has been completed by means of an electronic mail system through internet line 80. The user can confirm the updated images by accessing the web site later.

In the case described above, in order to issue a command to camera devices 21, 22 and 23 for acquisition of existing images, a mode (not shown in the figure) may be used in which server means 10 sends a message to communication device 20 directly by using public telephone line. In this case, communications device 20 contains a system that can confirm that there is a telephone signal or calling signal from server means 10. When it has been confirmed that there is a signal from server means 10, communications device 20 issues a command in the same way as described above to camera devices 21, 22 and 23 to transmit image data. Next, communications device 20, which has received the image data, establishes a connection to server means 10 through internet service provider 81 and provides the image data to server means 10. The subsequent operations are the same as in the case described above. The telephoning time by telephone line to communications device 20 from server means 10 in the early stage becomes relatively short time. Therefore, the costs that are generated by telephoning are comparatively inexpensive.

Incidentally, due to the "security on mode," there may be an inconvenience that camera devices 21, 22 and 23 are in operation when the owner returns home. In this case, there is the desirable feature that the user can change communications device 20 to the "off" mode by means of a wireless system from outside of the place 200 to be monitored. In the another alternative, when camera devices 21, 22 and 23 detect the movement of the user and recognize an unusual status, it is possible to change the mode to the "off" mode by operating communications device 20 within a specified time and to stop the transmission of the unusual status reporting signal to server means 10.

Next, we shall explain other two modes, the "time designation monitoring mode" and the "message sending mode" which are supplemental modes that can be added to the "off mode" and the "security on mode." These two other modes are not necessarily needed for crime prevention.

By means of the "time designation monitoring mode," a camera device is installed so that a specified object can be monitored and the object is monitored at a time designated by the user. This mode is used, for example, for observing pets, For example, camera device 21, as a result of receiving the command to acquire images from server means 10 thought communications device 20 at a time designated in advance, acquires images at that time. These image data are sent in the same way as in the "security on mode" and are stored in data base server 12. Consequently, the user can confirm the image by accessing the web site. In this mode, it is also possible for the user to acquire images by sending a command from the web site when user request at a non-designated time.

By means of the "message sending mode," as described above, for example, messages can be constructed of images and voice specified time length by using the function of voice detection unit 49 installed in camera device 21 where camera device 21 can be controlled by operating a control device that is installed in communication means 20 but that is not shown in the figure. This message can be stored on data base server 12 by the same method as in the "security on mode" described above. The presence of a new message is informed to the user by a system such as electronic mail to the user terminal or by a cell phone in the same way as in the method described above. The user can confirm the content of the message visually or by ear by accessing the web site. The images are not limited to dynamic images and may also be moving images during short periods.

In the foregoing, we have presented a detailed description of a security system which is a desirable mode of execution of this invention. However, this is strictly an illustration and does not limit this invention. Various modifications can be made by those skilled in the art.

We claim:

1. A security system for monitoring and reporting of an intruder of a specified place via a communication line, said system comprising:

a plurality of camera devices for monitoring said specified place, said camera devices comprising a data-processing component for detecting said intruder;

a communication device connected to said camera devices and a communication line including an internet line; and a server connected to said communication device by said communication line;

wherein said camera devices constantly monitor for intruders in said specified place, and said camera devices, upon detecting an unusual status caused by an intruder, establish a connection with said communication device to send an unusual status reporting signal and image data to said communication device, and said communication device establishes communication with said server only when said communication device receives said unusual status reporting signal, and collects said image data in predetermined units to send to said server.

2. The security system as described in claim 1, wherein said communications device is constructed such that units of said image data corresponding to said specified place are sent to said server means, and said image data are automatically deleted.

3. The security system as described in claim 1, wherein the units of said image data in a specified place include several items of image data obtained from one of said plurality of camera devices at different times.

4. The security system as described in claim 1, wherein an interconnection between said camera devices and said communication device are formed by a power source line or by wireless means.

5. The security system as described in claim 1, wherein said server provides image information based on said image data to a specified web site.

6. The security system as described in claim 1, wherein said server reports to a registered terminal upon receipt of said image data.

7. The security system as described in claim 6, wherein said reporting is performed using the internet.

8. The security system as described in claim 1, wherein said camera devices detect voice information, combine voice data based on said voice information with said image data, and transmit combined voice and image data.

9. The security system as described in claim 1, wherein said server includes a web server and a data base server.

* * * * *